United States Patent [19]

Hope et al.

[11] 4,090,818

[45] May 23, 1978

[54] ADJUSTABLE METERING PUMP

[76] Inventors: Henry F. Hope; Stephen F. Hope, both of 2421 Wyandotte Rd., Willow Grove, Pa. 19090

[21] Appl. No.: 689,739

[22] Filed: May 25, 1976

[51] Int. Cl.[2] ..... F04B 45/02; F04B 49/06; F16J 1/10

[52] U.S. Cl. ..... 417/473; 92/129; 92/13.2; 92/13.3; 92/13.5; 92/13.8

[58] Field of Search ..... 417/471, 472, 473, 214, 417/539; 92/129, 13.2, 13.5, 13.7, 13.8

[56] References Cited

U.S. PATENT DOCUMENTS

| | | | |
|---|---|---|---|
| 462,666 | 11/1891 | Dykes | 417/529 |
| 1,454,886 | 5/1923 | Giesler | 417/472 |
| 2,407,343 | 9/1946 | Pyne et al. | 417/214 |
| 2,564,793 | 8/1951 | Seter | 92/13.7 |
| 2,640,424 | 6/1953 | Babitch | 417/471 |
| 3,545,896 | 12/1970 | Zahradnik | 417/471 |
| 3,793,902 | 2/1974 | Grantham | 92/129 |
| 4,006,797 | 2/1977 | Keske | 417/471 |

FOREIGN PATENT DOCUMENTS

| | | | |
|---|---|---|---|
| 1,355,682 | 2/1964 | France | 417/472 |
| 1,595,361 | 6/1970 | France | 417/472 |
| 1,010,534 | 4/1964 | United Kingdom | 417/472 |

*Primary Examiner*—William L. Freeh
*Attorney, Agent, or Firm*—John B. Sowell

[57] ABSTRACT

A reciprocating adjustable stroke positive displacement fluid pump is provided with an expandable chamber driven in the displacement or feed direction by an eccentric drive acting through a driven member. The eccentric drive moves the expandable chamber to its limit of excursion in the displacement or feed direction. Adjustment means cooperating with stop means limits the excursion of the driven member and the expansion of the expandable chamber in the suction or intake direction so that the amount of fluid pumped is continuously adjustable from no volume to the capacity of the expandable chamber by positioning the stop means. The pump is further provided with means for driving a plurality of individually adjustable pumps from the same drive motor and with means for equalizing the load on the pump motor.

24 Claims, 13 Drawing Figures

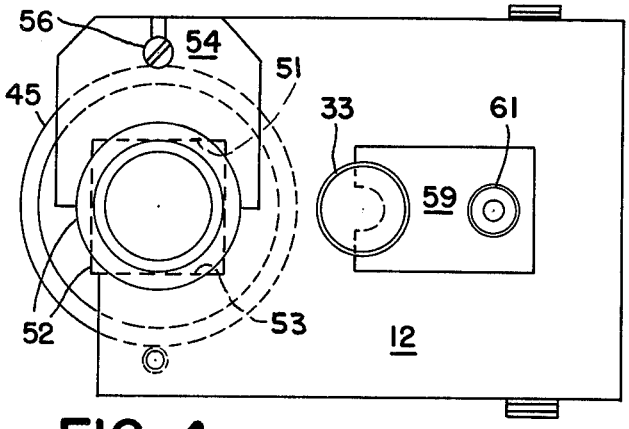
FIG. 4
FIG. 3
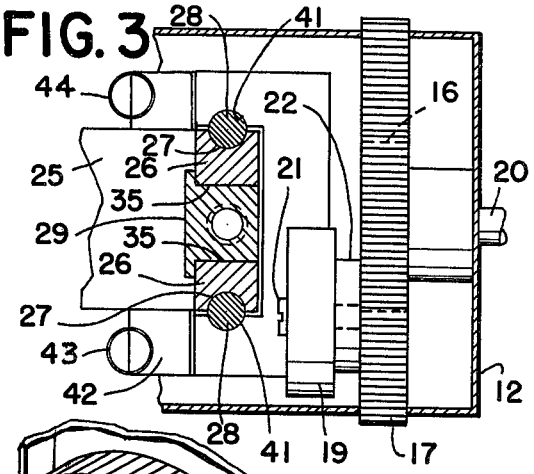
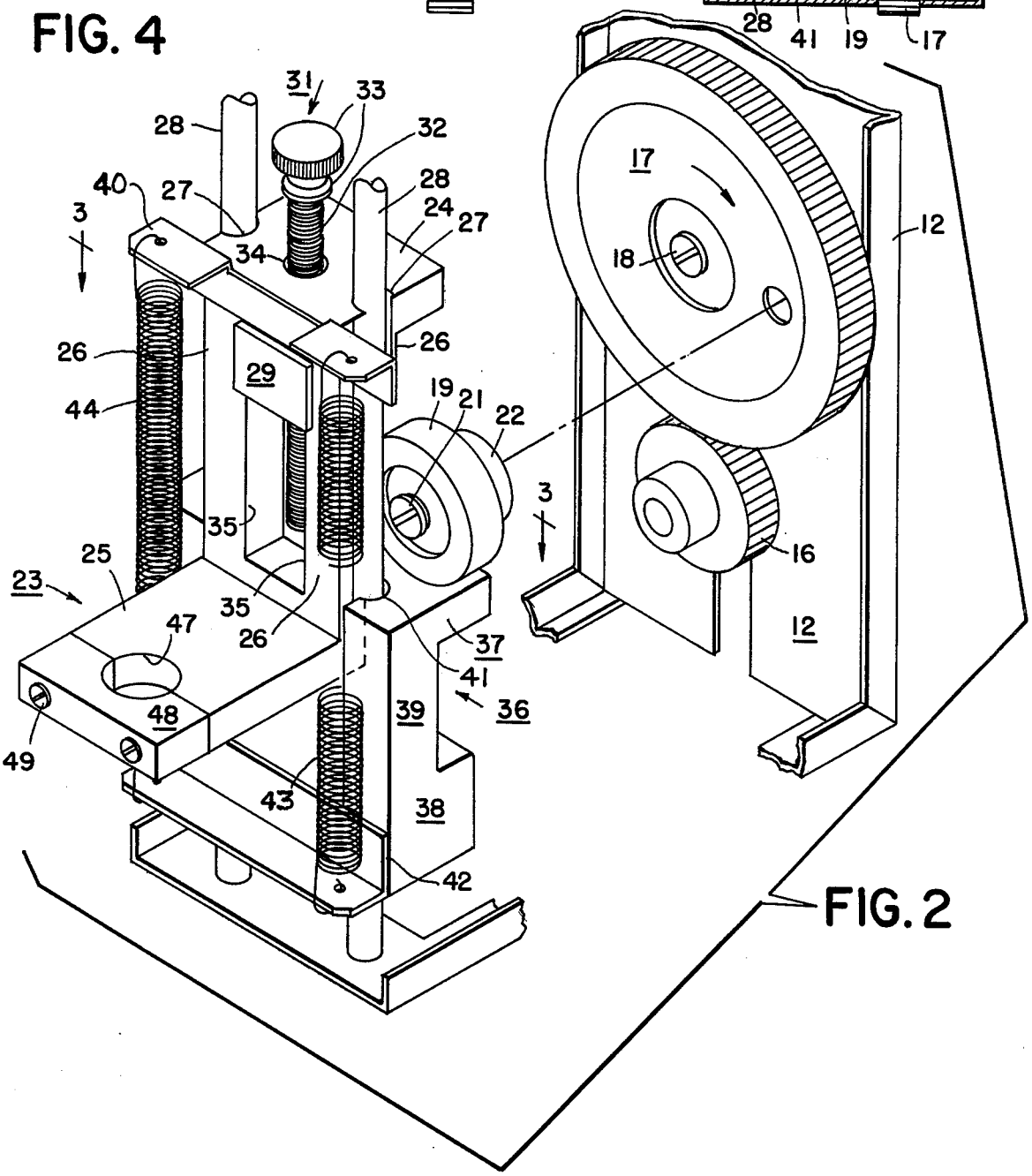
FIG. 2

ADJUSTABLE METERING PUMP

BACKGROUND OF THE INVENTION

1. Field of the Invention

The present invention relates to reciprocating powered pumps, and more particularly to reciprocating pumps which are provided with means for adjusting the positive displacement stroke of the pump.

2. Description of the Prior Art

Adjustable stoke positive displacement pumps are known. Some such pumps are provided with eccentric reciprocating drives. The piston or chamber is driven in the feed or displacement direction against the fluid head at the outlet and also against a return spring. When the drive for the piston attempts the return stroke the positive coupling is disconnected and the piston or chamber is returned to a predetermined limited position by the return spring.

Positive displacement pumps of the prior art types load the pump motor with the work of performing the feed stroke at the same time energy is stored in the return spring for performing the suction or intake stroke.

Heretofore, positive displacement pumps have been designed and manufactured as intregal assemblies. When such pumps are employed for metering pumps and the capacity limit of the pump is reached, the user has been forced to buy the next larger size pump.

Heretofore, a purchaser of a positive displacement metering pump has been limited in the accuracy available to a percentage of the maximum volume displacement of the pump being employed. Pumps employing large diameter chambers or pistons are limited in the accuracy of the adjustable stroke and as the volume being pumped is decreased the volume error remains constant regardless of the amount being pumped during each displacement stroke.

Heretofore, positive displacement pumps, especially those designed for metering chemicals, have employed check valves in the inlet lines and outlet lines which were connected through plenums to the piston or expandable chamber. Spring loaded valves of the prior art type are subject to deterioration of the valve materials. If metal springs are used the springs tend to deteriorate. If the springs are made very strong to resist deterioration and weakening, they tend to create wire drawing and or cavitation which causes errosion of the valve face and valve seats. Plastic pumps having moving pistons and concentric mating valves and seats tend to wear and or erode and are not suitable for metering pumps because leaks destroy the accuracy of the pump and its intended purpose.

Heretofore, pumps have been made from plastics which resist wear and chemical action, however such pumps have not been made in a manner which permits ease of replacement of all of the wearing parts, moving parts and parts subject to field replacement.

There is an unfullfilled need for a cheap reliable and accurate positive displacement metering pump which is resistant to most chemicals.

SUMMARY OF THE INVENTION

The present invention provides a simple reliable positive displacement reciprocating pump having means for adjusting the fluid being displaced during each feed stroke.

It is a primary object of the present invention to provide a novel and more efficient power drive for a positive displacement fluid pump.

It is another primary object of the present invention to provide means for driving a plurality of positive displacement pumps from a single motor drive.

It is another object of the present invention to provide a novel positive displacement pump where all of the components subject to normal wear are mounted on a frame exposed to view for ease of inspection and or replacement.

It is another object of the present invention to provide a novel reciprocating pump drive fitted with easily replacable expandable chamber assemblies or valve assemblies of the same or different size.

These and other objects of the present invention are achieved by providing an adjustable stroke positive displacement power drive for a fluid pump which cooperates with a replacable expandable chamber coupled to a replacable valve assembly mounted on the same frame as the power drive. The power drive acts through a driven member to displace the expandable chamber in a feed or displacement stroke direction, however, the power drive does not act directly on the driven member in the suction or intake stroke direction. The power for accomplishing the suction or intake stroke is provided by the power drive acting through a resilient member to displace the expandable chamber in the intake or suction direction. Adjustment means are provided on the frame for limiting the intake or suction stroke of the expandable chamber and hence the amount of fluid to be displaced during the next subsequent feed or displacement stroke.

BRIEF DESCRIPTION OF THE DRAWINGS

FIG. 2 is an exploded isometric view of the drive mechanism of the motor driven pump of FIG. 1.

FIG. 3 is a section in plain view taken at lines 3—3 of FIG. 2.

FIG. 4 is a top view of the pump and drive mechanism shown in FIG. 3.

DESCRIPTION OF THE PREFERRED EMBODIMENT

Figure 1:
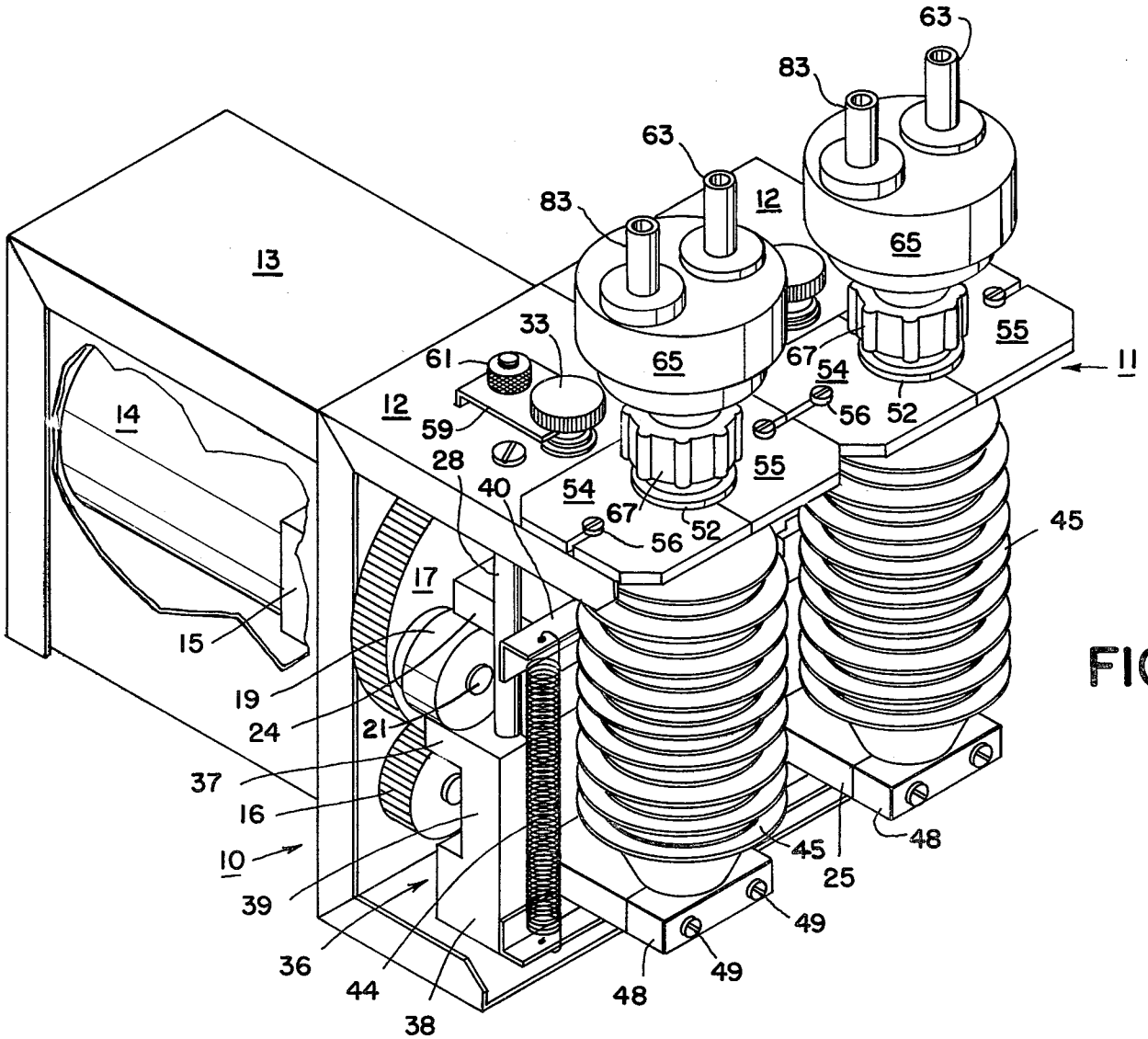
FIG. 1 is an isometric view of two pumps arranged to be driven from a single motor.

Refer now to FIG. 1 showing two novel reciprocating positive displacement pumps of the type used for metering fluid. Pump 10 and pump 11 are both provided with a main frame 12 for supporting the pumps. A separate subframe 13 is provided for the pump on the left for supporting a motor 14 and reduction gears 15 connected to a drive gear 16 by a shaft 20. Drive gear 16 which is turned by motor 14 has teeth which engage driven gear 17 rotatably supported on a stub shaft 18 mounted on frame 12.

A roller 19, shown in FIGS. 1 and 2, is rotatably mounted on a second stub shaft 21 which is fixedly mounted on driven gear 17. Stub shaft 21 has a slotted cap which form a keeper on one side of the roller 19 which is positioned by spacer 22 on the other side. Roller 18 is mounted radially outward from the center of driven gear 17 and imparts a reciprocating motion to driven members as will be explained hereinafter. It will be understood that the reciprocating drive motion imparted by eccentric drive means 17, 19 could be produced by a single piston, a cam or a cam driving a pivoted lever or numerous other known mechanical devices. The eccentrically mounted roller 19 is a preferred mode of operation due to simplicity, economy and reliability.

Driven gear 17 may be rotated in either direction and for purposes of the discussion that follows a clockwise rotational direction in FIG. 2 will be assumed as shown by the arrow. The roller 19 in FIG. 1 is shown at 180° of rotation and the roller in FIG. 2 is shown at 90° of rotation. Having assumed a clockwise rotation of roller 19, the first 180° of rotation comprises the suction or intake stroke, or drive in the intake direction of the pump. The last 180° of rotation of roller 19 comprises the discharge or feed stroke, or drive in the feed stroke direction of the pump. When direction of rotation is reversed the first half revolution of roller 19 still comprises drive in the intake direction.

Roller 19, to perform some pumping operation, must engage the first driven member 23 which, in the preferred embodiment shown, comprises a Z-shaped structural member 23 having an upper arm 24 and a lower arm 25 connected by webs 26. The outside of webs 26 have guide slots 27 therein provided for slidably mounting the first driven member 23 on guide rods 28 which are connected between the sides of frame 12.

The limit of movement of the first driven member 23 in the feed stroke direction is defined by the roller 19 engaging upper arm 24. The lower limit of movement of the first driven member 23 in the suction or intake stroke direction is defined by the stop block 29 of adjustable stop means 31 comprising a threaded bolt 32. Bolt 32 has a flanged knob 33 at the upper end which rests on the top surface of frame 12. The bolt 32 mounts through an aperture in the frame 12 and through an oversized smooth bore 34 in upper arm 24. The threaded lower end of bolt 32 engages the threads in stop block 29. The stop block 29 is T-shaped and slidably mounted between webs 26 which form a slot or guide 35 for the stop block 29. It will be noted stop block 29 may be moved so high as to prevent roller 19 from engaging upper arm 24, and may be moved so low as to traverse the length of guide 35 without engaging the bottom of the guide 35.

Roller 19 in FIG. 2 is shown engaged with the second driven member 36 which comprises upper arm 37 and lower arm 38 connected by webs 39 to form a C-shaped structural member. The inside of webs 39 have guide slots 41 therein provided for slidably mounting the second driven member 36 on guide rods 28. As driven gear 17 rotates clockwise, roller 19 engages the upper arm 37 of second driven member 36 depressing it downward. Angle shaped lower spring bracket 42 is mounted on webs 39 of member 36 and have the lower ends of resilient members 43, 44 mounted thereon. The upper ends of resilient members or springs 43, 44 are connected to angle shaped upper spring bracket 40 which is mounted on webs 26 of member 23. When the roller 19, as in FIG. 2, forces the second driven member 36 downward, springs 43, 44 are placed in tension and force the first driven member 23 downward causing member 23 to engage stop 29. It will be observed that when stop 29 is in its uppermost position, springs 43, 44 are extended to a maximum tension stress condition. When block 29 is adjusted downward to the bottom of the slot 35 springs 43, 44 will be placed in a minimum stress condition because member 23 is following member 36 as if the springs were a substantially rigid connection therebetween.

When stop 29 is at or near its upper limit the first driven member 23 has no downward movement in the intake stroke direction, thus, the expandable chamber 45 connected to lower arm 25 does not take in fluid and is not moved in the feed stroke direction to discharge fluid. When stop 29 is at or near its lower limit the upper arm 24 of first driven member 23 follows roller 19 in the intake stroke direction, thus, the expandable chamber 45, connected to lower arm 25, takes in the maximum amount of fluid and is moved the maximum distance in both the intake stroke direction and subsequently in the feed stroke direction.

Refer now to FIGS. 1 and 2. Assume that in FIG. 1 the stop 29 has been adjusted to the bottom of slot 35 by rotating knob 33 and bolt 32, and that roller 19 is at 180°. First driven member 23 will be forced by springs 43, 44 to its lowest possible excursion creating the maximum intake or suction stoke for expandable chamber 45. If the motor 14 is stopped at this point, member 34 is free to be moved upward causing chamber 45 to execute a feed stroke. It is a feature of the present invention to be able to stop the motor 14 so that each pump 10, 11 etc is positioned at its 180° suction stroke position and to manually manipulate the expandable chamber 45 through the suction and feed stroke. By measuring the discharge from the chamber from several strokes, the fluid metered per stroke can be accurately determined from each individual pump.

In the preferred embodiment use, several pumps 10, 11 etc may be driven from one motor. Each of the pumps may be metering a different chemical. In applications where the metering pumps are employed for chemical replenishment, such as in color photography, the motor drives the pumps very slow, and it is important to be able to set up a plurality of pumps fast and accurately. This is accomplished by setting the pump to the end of the suction stoke, manually adjusting stop block 29 and manually pumping fluid until the precise flow is obtained. Driven gears 17 of each of the adjacent pumps are mounted on frame 13 so that the pitch circle of the gear teeth extends to or beyond the edge of frame 12 (as shown in FIGS. 3 and 4). The pumps may be mounted is synchronous rotational adjustment or in random adjustment without affecting the power requirements on the motor because the pump is adapted to require a balance load during a complete cycle as will be explained in greater detail hereinafter.

Expandable chamber 45 is shown as a bellows 45 and in a preferred embodiment is made of resilient non work-hardening plastic such as polyethylene or polypropolene or similar flexible semi rigid plastics. Bellows can be made from metals such as stainless steel or copper when circumstances require, however, the plastic bellows illustrated are capable of lasting over five million strokes. Should the bellows wear out or the diameter is not optimum for the stroke of the eccentric drive 17, 19, the bellows is easily replaced. The lower closed end of bellows 45 is terminated with a cylindrical neck 46 which fits into the bifurcated end 47 of lower arm 25. In the preferred embodiment shown, a yoke 48 is attached by screws 49 to the end of lower arm 25, thus, providing a tight wear free lower restraint for the semi rigid flexible plastic bellows 45.

The upper open end of bellows 45 is provided with a rectangular neck 51 positioned between two shoulders or flange portions 52 which fits into the bifurcated edge 53 of frame 12. Two thick keeper plates 54, 55 are provided with rectangular slots which are forced between the shoulders 52 to embrace the neck 51 and to provide a tight wear free upper restraint. Screws 56 are shown for holding the plates 54, 55 in place, however, other means such as tabs or projections on the frame will permit the keeper plates to be snapped in place. It will be understood that bifurcated ends 47, 53 may be built up and adapted for snap out removal of bellows 45 without the need for additional restraints, and such structure would be desirable in situations where the size of the bellows is to be changed often or change to different chemicals requires a change of bellows.

In the preferred embodiment shown in FIGS. 1 to 4 it is assumed that a large part of the available stroke will be utilized because the spring retaining angle brackets 42, 40 are oriented down and up respectively. These brackets 42, 40 may be reversed so that there is less distance between the ends of the springs 43, 44. When the stop block 29 is positioned high, very little fluid is pumped and the springs 43, 44 are stretched appreciably, thus, it may be desirable to employ a smaller diameter bellows and/or reverse the spring brackets 42, 40 and/or employ lighter springs to lighten the load on motor when little fluid is being pumped.

It will be noted that during a maximum pumping stroke the upper arms 24 and 37 of the two driven members 23 and 26 will form sides of a loose basket 58 and that there is a minimum amount of tension in springs 43, 44 during the entire revolution of driven gear 17 and roller 19. The preferred embodiment pump is designed to have a minimum of work imposed on the motor 14 when the pump or pumps are doing the most fluid pumping. Prior art expandable pistons or expandable chambers imposed spring loads and friction loads on the pump motors during a maximum displacement feed stroke. The present novel pump drive is adapted to equalize the load on the motor over the entire revolution of the eccentric drive 17, 19 and thus enable a smaller motor to be employed to drive a plurality of the novel friction free pumps.

After each pump is adjusted for optimum loading and fluid displacement there is provided clamp means for locking the adjustable stop means 29 to 33 at the setting. Bifurcated angle plate 59 embraces the flange on knob 33 and is held in friction engagement therewith by a knurled threaded screw 61 cooperating with a threaded stud on frame 12.

Figure 6:
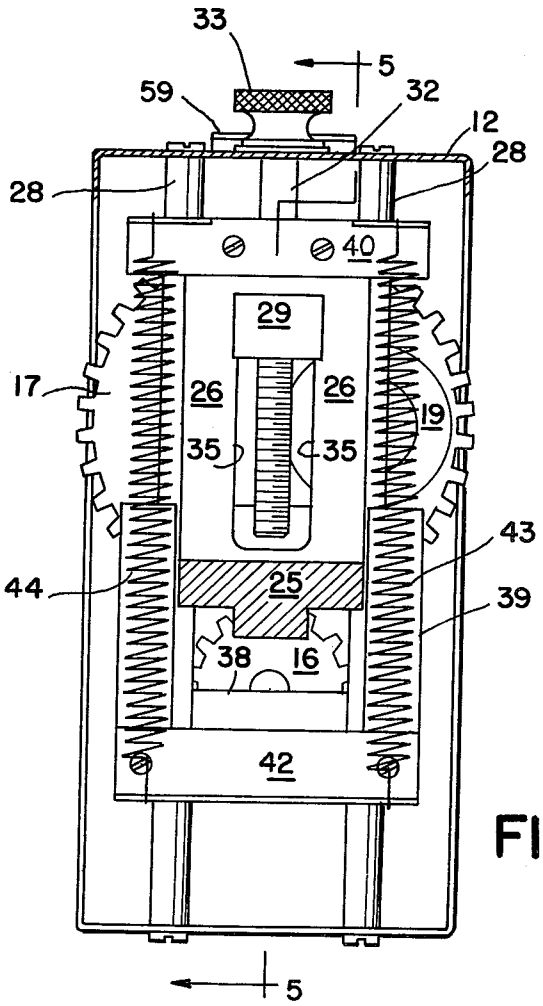
FIG. 6 is a front elevation in partial section taken at lines 6—6 of FIG. 5.
Figure 5:
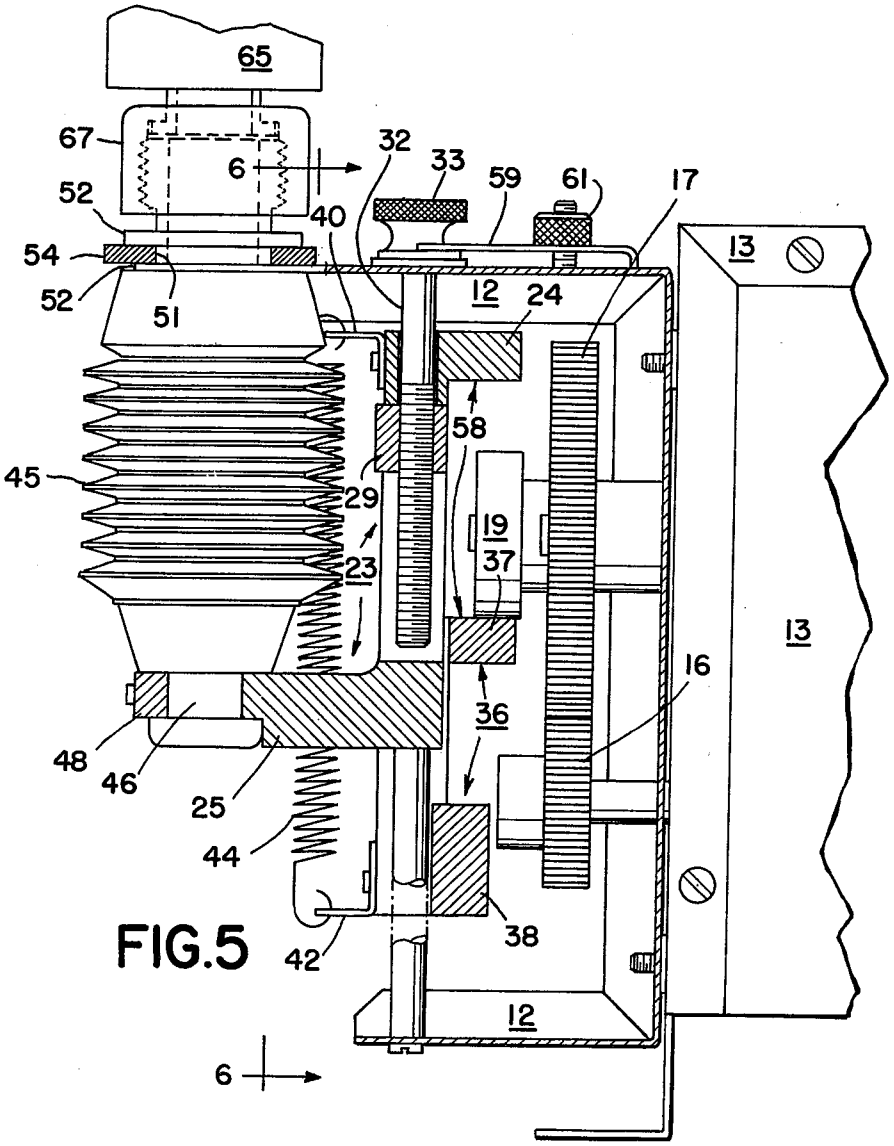
FIG. 5 is a side elevation in partial section of the motor driven pump shown in FIGS. 1 to 4 in the center of the suction or intake stroke.
Figure 8:
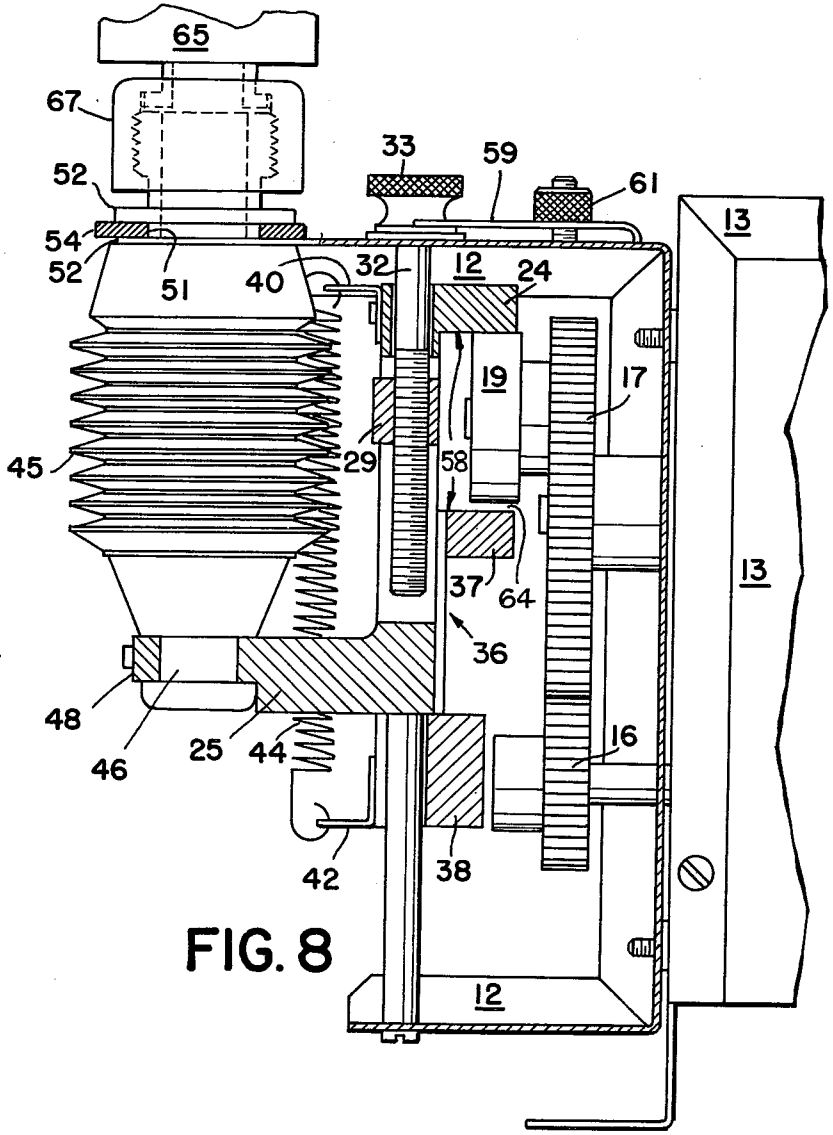
FIG. 8 is a side elevation in partial section of the motor driven pump of FIGS. 1 to 7 at the end of the displacement or feed stroke.
Figure 7:
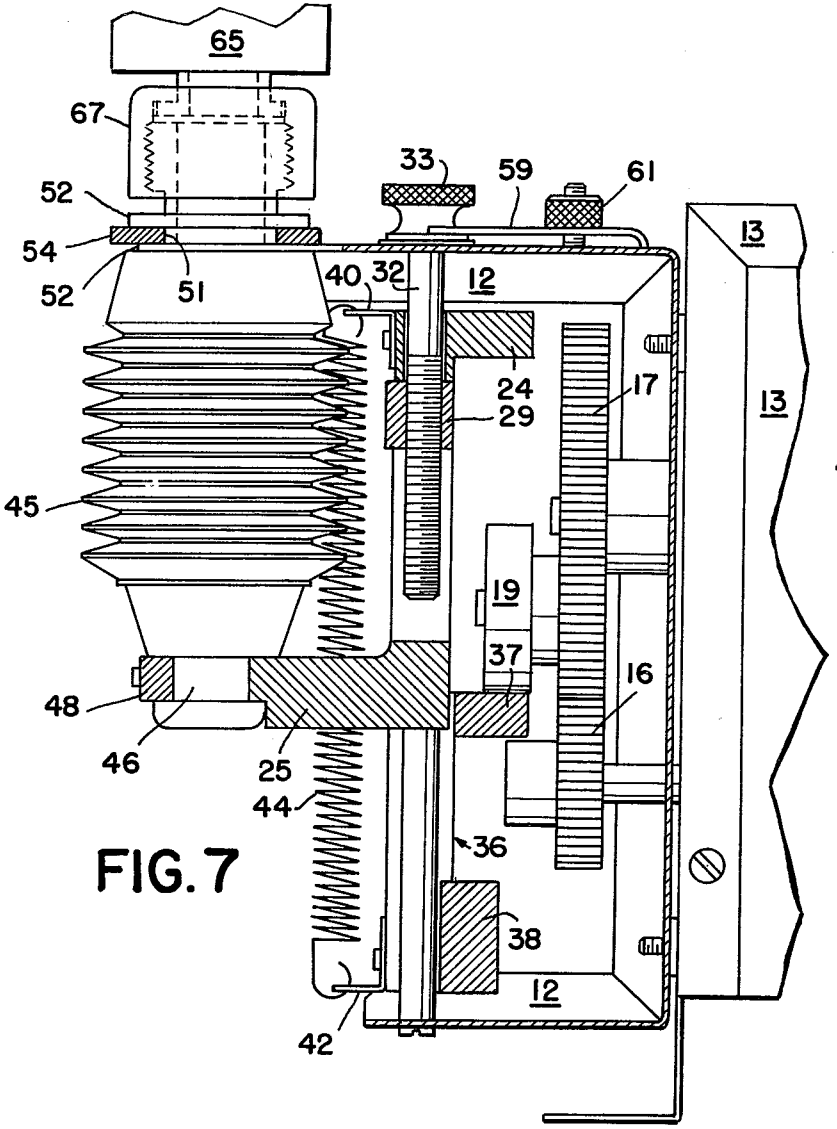
FIG. 7 is a side elevation in partial section of the motor driven pump shown in FIGS. 1 to 6 at the end of the suction or intake stroke.

Refer now to FIGS. 2 and 5 to 8 showing stop 29 adjusted to a high stop position. To illustrate the mode of operation when little or no fluid is being pumped, the stop is shown adjusted so that a small amount of fluid will be pumped. In FIGS. 5 and 6 the roller 19 is at the 90° position or half way through its suction or intake stroke. The roller 19 has disengaged upper arm 24 of Z-shaped member 23 and the first driven member 23 has moved downward to rest on stop 29. Roller 19 has engaged upper arm 37 of the second driven member 36 and started to stretch or extend springs 43, 44. At this point in time lower arm 25 of member 23 and bellows 45 have completed their suction stroke and no additional fluid may be drawn into bellows 45. FIG. 7 shows roller 19 and second driven member 36 at the extreme excursion of their intake stroke which at 180° is also the start of their feed stroke, but not the start of the physical displacement of fluid from bellows 45 because stop means 29 is set relatively high. Due to the stop 29 being set high, springs 43, 44 are stretched to the point of highest tension. FIG. 8 shows roller 19 back at the 360° or 0° position engaged with upper arm 24 of the first driven member 23. The stop 29 has not moved but the top of slot 35 and upper arm 24 have moved slightly up and away from stop 29. During this slight movement the bellows 45 has been displaced in the feed stroke direction causing fluid to be pumped into the valve assembly 65 and out of the discharge line 63 as will be explained hereinafter. During the next few degrees of rotation, roller 19 starts downward in FIG. 8 and bellows 45 will complete the intake or suction stroke as soon as member 23 comes to rest on stop means 29.

Figure 10:
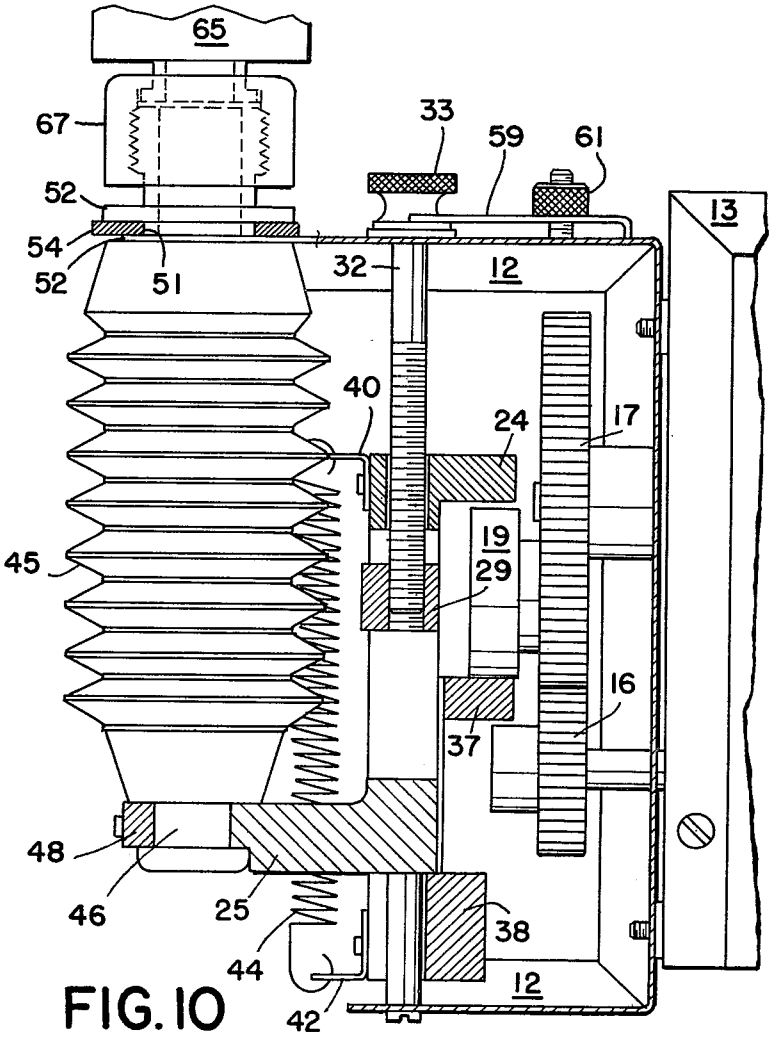
FIG. 10 is a side elevation in partial section of the motor driven pump of FIG. 9 in the center of a suction or intake stroke.
Figure 9:
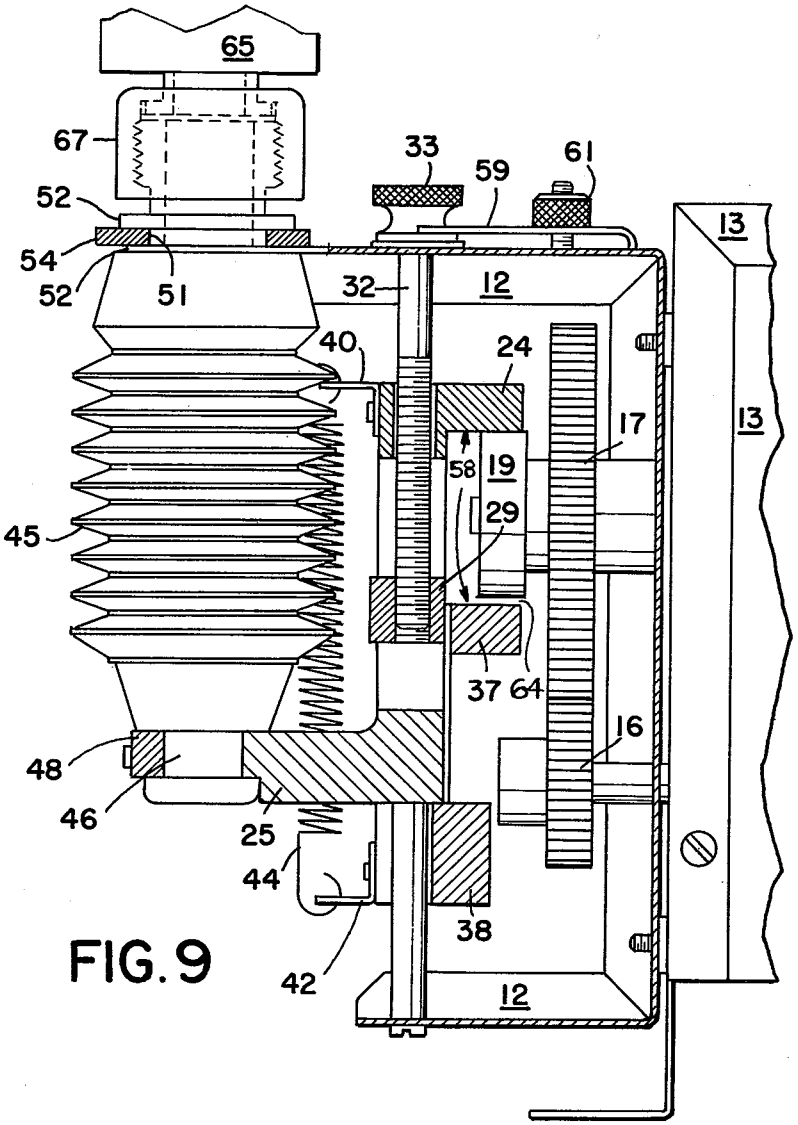
FIG. 9 is a side elevation in partial section of the motor driven pump of FIG. 1 in the center of the suction or intake stoke with the adjustable displacement stop moved to its furtherest excursion.
Figure 11:
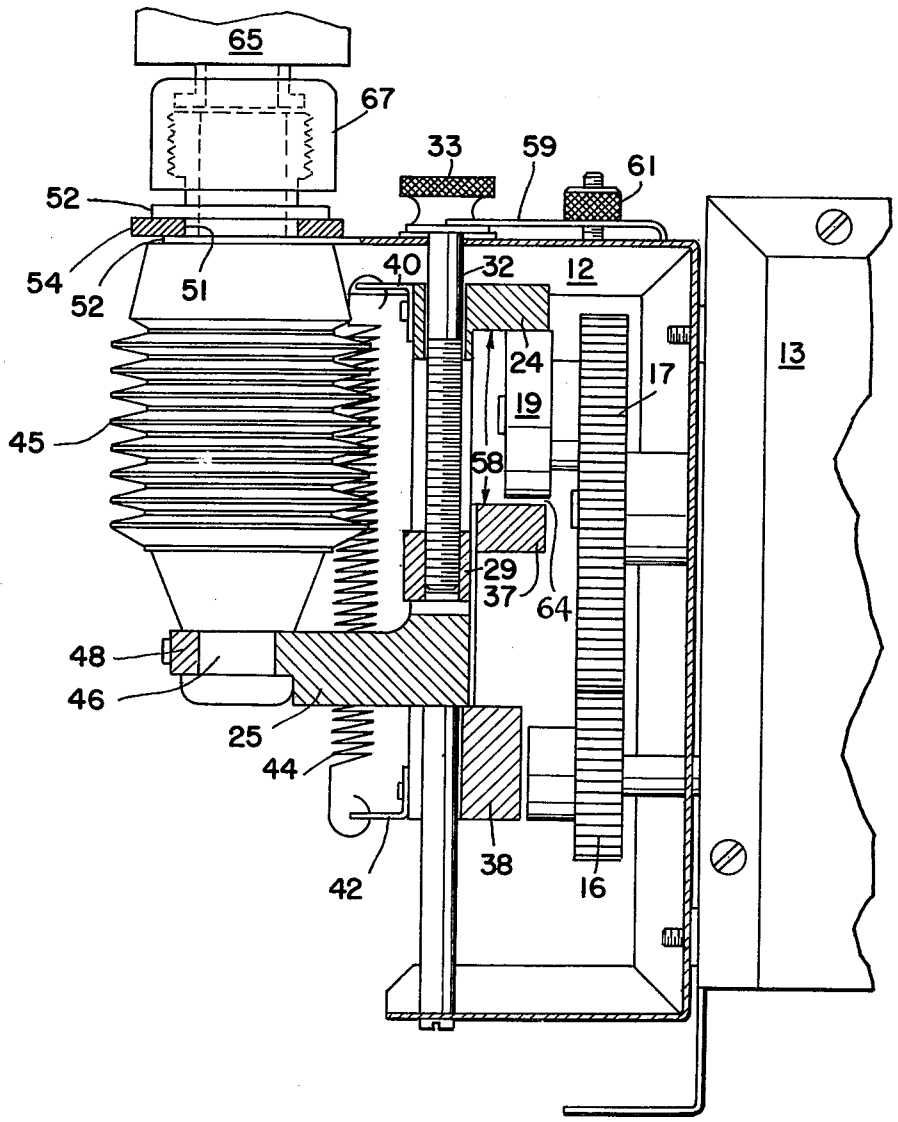
FIG. 11 is a side elevation in partial section of the motor driven pump of FIG. 10 at the end of the displacement or feed stroke.

Having explained a very short feed or discharge stroke of bellows 45 refer now to FIGS. 9, 10 and 11 showing stop means 29 at or near its furtherest down excursion which defines the maximum pumping ability of the diameter of bellows 45 shown. A larger bellows 45 moved over the same feed stroke would pump a greater amount of fluid.

FIG. 9 shows roller 19 at the 90° rotational position. Even though upper arm 24 of member 23 has started downward causing lower arm 25 to expand bellows 45, only half of the suction or intake stroke of all the pump components has yet occured. The middle portion of lower arm 38 is now engaged on the bottom of lower arm 25 and there is provided a small gap 64 between roller 19 and upper arm 37. Thus, it is seen that roller 19 is loosely entrapped between arms 24 and 37 which form the side of a loose basket 58. Since arms 24 and 37 cannot simultaneously entrap roller 19, it is free to rotate without exerting a friction drag on motor 14.

FIG. 10 shows roller 19 at the extreme excursion point of 180° of the suction or intake stroke. Since stop 29 is set below the furtherest stop point for interference with member 23, roller 19 is defining the downward position of member 36 and its upper arm 37. The lower arm 25 of member 23 is resting on lower arm 37 and member 23 is unable to move further down and engage stop 29. Thus, it will be understood that when member 23 does not engage stop 29 during one revolution of the eccentric drive 17, 19 that the maximum amount of fluid will be pumped during each cycle.

FIG. 11 shows the roller 19 returned to the 360° rotational position. There is a small clearance between arm 37 and roller 19 and between stop 19 and the bottom of guide 35. Arm 38 is engaged on the bottom of arm 25.

Having explained a preferred embodiment pump having an eccentric drive adapted to drive an expandable chamber 45 in the feed direction and to spring bias the expandable chamber 45 in the suction direction it will be understood that each of the components of the pump and drive is readily accessible for visual inspection, replacement and/or repair.

Figure 12:
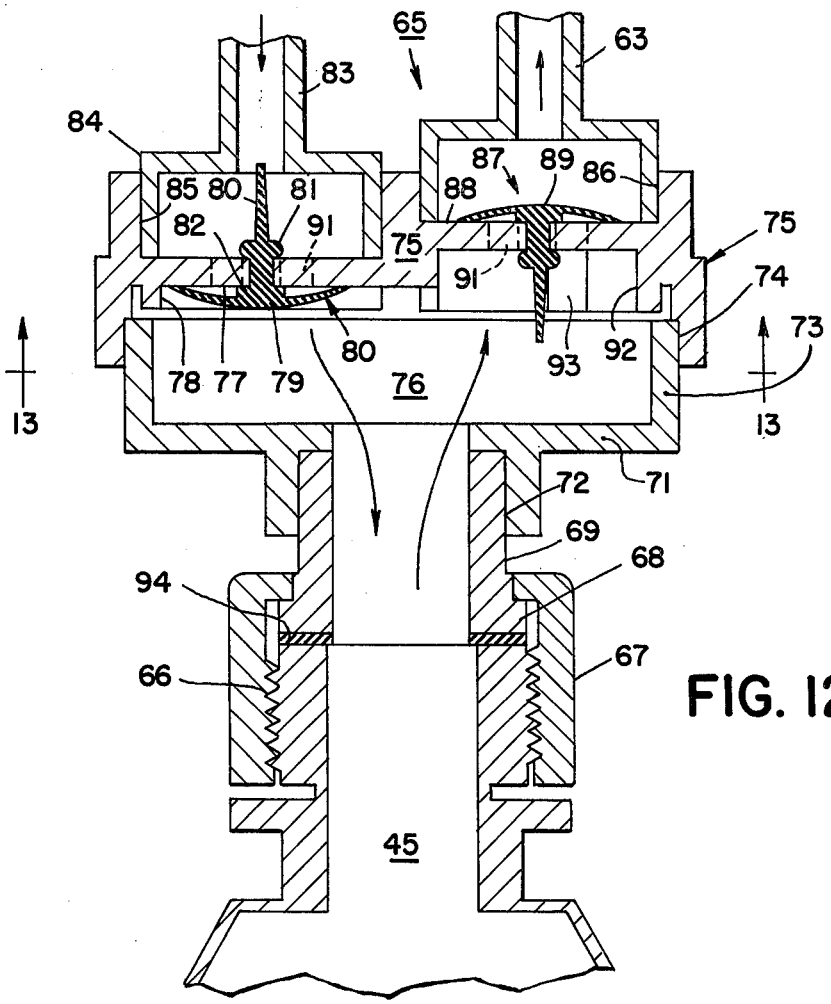
FIG. 12 is an enlarged section taken through the expandable chamber and novel valve structure.
Figure 13:
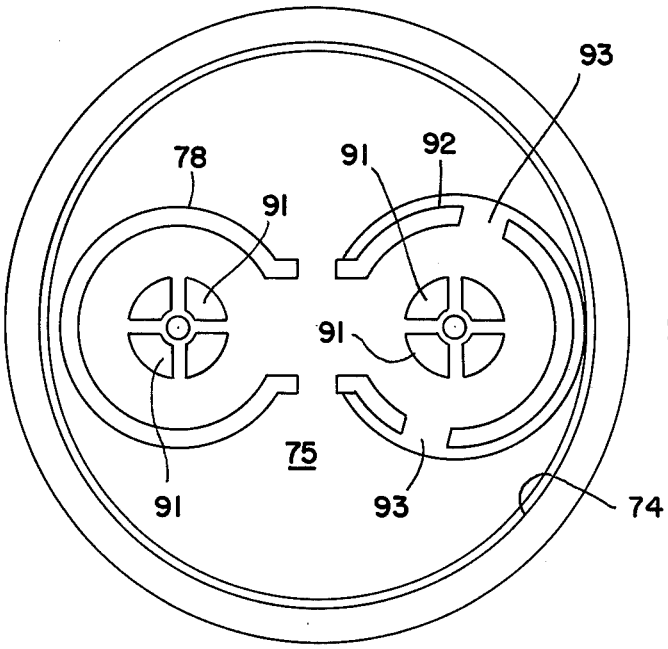
FIG. 13 is a bottom view looking into the upper valve body of the valve structure of FIG. 12 taken at lines 13—13 of FIG. 12.

The novel pump is further provided with externally located easily replacable valve components which control the intake and discharge of fluids to and from the expandable chamber 45. Refer now to FIG. 12 showing a detail of the valve assembly 65 shown in FIG. 1. The top open end of expandable chamber 45 is provided with external threads 66 engagable with threads on cap 67. Cap 67 is fitted over a annular flange 68 on cylindrical tubular shaped outlet member 69. Outlet member 69 is cemented into lower valve body 71 at an annular recess 72 provided therefor. Lower valve body 71 has an upper tubular extension 73 which fits into an annular recess 74 of upper valve body 75 and forms a plenum chamber 76 therewith. The lower valve face 77 of the intake valve is surrounded by a discontinuous annular ring 78 which shields the extremely flexible crowned disk 79 of mushroom valve seat 80. The stem 80 of valve seat 80 is provided with an enlarged bulb 81 which holds the spacer ring 82 against valve face 77. Inlet line 83 is provided with an enlarged tubular termination 84 which fits concentrically in an annular recess 85 on the upper valve body 75. Similarly, discharge line 63 is fitted and cemented into annular recess 86 forming a chamber for valve seat 87 engaged with upper valve face 88. Both valve faces 88 and 77 are perforated below the crowned disks 89 and 79 to permit the flow of fluid to pass through the valve faces 88 and 77 and to lift the crowned disks 89 and 79. The preferred embodiment mushroom shaped valve seats 80, 87 are identical in shape and are designed to lightly engage an annular surface around the perforations 91 in the valve faces. When such valve seats are made of extremely flexible material such as plastics and/or synthetic rubbers, the valve assemblies 65 are self priming and capable of pumping air or gas to initiate liquid flow therethrough. When gas and liquid are supplied through the inlet line 83, the annular ring 78 serves to prevent gas build up in the plenum 76. As shown in FIGS. 12 and 13 the annular ring is shaped to encourage fluid flow toward the outlet 63, thus, the fluid sweeps the entrapped gas bubbles out of the chamber 76. A discontinuous annular ring 92 surrounds the bottom of discharge valve 87, 88, 89. The discontinuities or gates 93 in the ring 92 are adapted to permit entrapped gas bubbles to be flushed through the valve 87, 88, 89 as fluid flows into outlet 63. It will be observed that the components of valve assemblies 65 are shaped to enable manufacture by injection moulding. After the mushroom valve seats 80, 87 are placed in the upper valve body 75, the lower valve body 71 and the outlets 63, 69 and inlet 83 may be assembled by cementing the nesting concentric components together. The valve assembly 65 is preferably sealed at the connection with the expandable chamber by a plastic washer 94, however, a seal may be provided by providing mating beveled faces and seats on the outlet member 68 with the opening in chamber 45.

Having explained a preferred embodiment pump, pump drive, and valve assembly it is apparent that different forms of expandable chambers, eccentric drives and valve assemblies may be used in the displacement pump described. While slidable driven members are shown mounted or rod guides and biased by tension springs, it is known that the same motions and mode of operation may be obtained by pivoted linkages and/or devices employing compression springs. The preferred embodiment structures were chosen for simplicity and reliability after testing the alternatives. The pump described is capable of pumping a fraction of a cubic centimeter of fluid up to hundreds of cubic centimeters with a very high degree of accuracy. The pumps may be driven from the same drive while pumping different amounts and the discharged fluids may be dispensed separately or fed to a manifold on parallel arrangement.

We claim:

1. A reciprocating positive displacement pump of the type having an expandable chamber operable in a feed stroke direction and in a suction stroke direction comprising:

a frame, a reciprocating drive mounted on said frame, a first driven member slidably mounted on said frame for movement in the feed stroke direction by said reciprocating drive, a second driven member slidably mounted on said frame for movement in the suction stroke direction by said reciprocating drive, resilient means mounted on said second driven member biasing said second driven member in said feed stroke direction, an expandable chamber mounted on said frame having an open end and a closed end, said first driven member being connected to the closed end of said expandable chamber for movement therewith, said second driven member being coupled to said expandable chamber through said resilient means for causing movement of said expandable chamber in the suction stroke direction, adjustable stop means for limiting the movement of said first driven member in the suction stroke direction and said open end of said expandable chamber being adapted to be connected to valve means having an inlet valve which only opens when said closed end of said expandable chamber is operated in the suction stroke direction, said valve means further having an outlet valve which only opens when said closed end of said expandable chamber is operated in the feed stroke direction.

2. A reciprocating positive displacement pump as set forth in claim 1 wherein said first driven member comprises a lower arm having a bifurcated shape for receiving the closed end of said expandable chamber, and wherein said frame is provided with a bifurcated member for receiving the open end of said expandable chamber whereby said expandable chamber is readily replacable by removal from said bifurcated members.

3. A reciprocating positive displacement pump as set forth in claim 1 wherein said adjustable stop means comprises:

a threaded bolt rotatably mounted through an aperture in said frame and into said adjustable stop means, a knob connected to said threaded bolt at the outside of said frame, and clamp means mounted on said frame for restraining said bolt and said knob from turning.

4. A reciprocating positive displacement pump as set forth in claim 3 wherein said clamp means comprises a bifurcated angle clamp held in friction contact with said frame and said knob by a bolt in said frame.

5. A reciprocating positive displacement pump as set forth in claim 1 wherein said resilient means comprise tension spring means.

6. A reciprocating positive displacement pump as set forth in claim 5 wherein said tension spring means is in its lowest state of tension at the end of said feed stroke.

7. A reciprocating positive displacement pump as set forth in claim 6 wherein said tension spring means is in its highest state of tension at the end of said suction stroke.

8. A reciprocating positive displacement pump as set forth in claim 1 wherein said frame further includes:

slide guide means mounted between opposite sides of said frame, and wherein said first driven member is mounted for slidable movement on said slide guide means.

9. A reciprocating positive displacement pump as set forth in claim 8 wherein said slide guide means comprise a pair of rods, and wherein said first driven member is mounted between said pair of rods.

10. A reciprocating positive displacement pump as set forth in claim 8 wherein said adjustable stop means comprises a stop block mounted for slidable movement on said first driven member.

11. A reciprocating positive displacement pump as set forth in claim 10 wherein said adjustable stop means further comprises a threaded bolt rotatably mounted through an aperture in said frame and threadably engaged into threads in said stop block.

12. A reciprocating positive displacement pump as set forth in claim 1 wherein said reciprocating drive comprises:

a rotatable member pivotally mounted on said frame, and an eccentric drive mounted on said rotatable member.

13. A reciprocating positive displacement pump as set forth in claim 12 wherein said eccentric drive comprises a roller mounted radially off the center of said rotatable member, and wherein said first driven member comprises an upper arm adapted to engage said roller, and wherein said second driven member comprises an upper arm adapted to engage said roller, said upper arms of said driven members forming expandable sides of a basket engageable with said roller.

14. A reciprocating positive displacement pump as set forth in claim 12 wherein said first driven member comprises:

a Z - shaped structural member having, an upper arm adapted to engage said eccentric drive, a lower arm connected to said expandable chamber, and a web connecting said arms mounted for slidable movement on said frame.

15. A reciprocating positive displacement pump as set forth in claim 14 wherein said second driven member comprises:

a C - shaped structural member having, an upper arm adapted to engage said eccentric drive, a lower arm, and web means connecting said arms mounted for slidable movement on said frame.

16. A reciprocating positive displacement pump as set forth in claim 15 wherein said frame comprises a pair of rods mounted between opposite sides of said frame, and wherein said web of said Z-shaped member is mounted for slidable movement between said rods, and wherein said web means of said C-shaped member is mounted for slidable movement on the outside of said rods and said web of said Z-shaped member.

17. A reciprocating positive displacement pump as set forth in claim 14 wherein said Z-shaped structural member is further provided with a guide slot and said adjustable stop means comprises a stop block mounted for slidable movement in said guide slot.

18. A reciprocating positive displacement pump as set forth in claim 17 wherein said eccentric drive is cooperable with said second driven member to move said expandable chamber to the full limit of the suction stroke and to engage said first driven member against said stop block.

19. A reciprocating positive displacement pump as set forth in claim 18 wherein said first driven member is free to be manually moved in the feed stroke direction when said second driven member is at the full limit of the suction stroke, whereby said expandable member may be manually operated to deliver a predetermined amount of fluid by measuring the fluid pumped during a manual feed stroke.

20. A reciprocating positive displacement pump as set forth in claim 12 wherein said rotatable member comprises a driven gear having a pitch circle which extends to the edge of said frame.

21. A reciprocating positive displacement pump as set forth in claim 20 which further includes:

a drive gear rotatably mounted in said frame in engagement with said driven gear, and a drive motor mounted adjacent said frame for turning said drive gear, whereby said drive motor is adapted to drive a first driven gear in a first reciprocating pump and said driven gear is adapted to engage and drive another driven gear in another reciprocating pump mounted adjacent thereto.

22. A reciprocating positive displacement pump of the type having expandable chambers operated in a feed stroke direction and in a suction stroke direction comprising:

a first frame, a drive motor supported on said first frame, a reduction gear supported on said first frame and coupled to said drive motor and having a reduced speed output shaft, a first driven gear pivotally mounted on said first frame and coupled to said reduced speed output shaft, a first expandable chamber mounted on said first frame, a first driven member connected between said first driven gear and said first expandable chamber for movement of one end of said expandable chamber, a second frame connected to and adjacent to said first frame, a second driven gear pivotally mounted on said second frame and meshed with said first driven gear, a second first expandable chamber mounted on said second frame, a second driven member connected between said second driven gear and said second expandable chamber for movement of one end of said expandable chamber, whereby a plurality of expandable chamber displacement pumps are driven from a single drive motor, and first and second valve means connected respectively to said first and second expandable chambers each having an inlet valve which only opens when its associated expandable chamber is operated in a suction stroke direction, each said valve means further having an outlet valve which only opens when its associated expandable chamber is operated in the feed stroke direction.

23. A reciprocating positive displacement pump as set forth in claim 22 wherein said first driven gear is provided with an eccentric drive for importing motion to said first driven member.

24. A reciprocating displacement pump as set forth in claim 22 wherein said first driven member comprises a Z-shaped member slidably mounted on said first frame and connected to an end of said expandable chamber for movement therewith.

* * * * *